US008083591B2

(12) United States Patent
Fulton et al.

(10) Patent No.: US 8,083,591 B2
(45) Date of Patent: Dec. 27, 2011

(54) GAME HOSTING SERVICE

(75) Inventors: Bill Fulton, Seattle, WA (US); Andrew Farrier, Sammamish, WA (US); Bruce Phillips, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 957 days.

(21) Appl. No.: 11/748,761

(22) Filed: May 15, 2007

(65) Prior Publication Data

US 2008/0287190 A1 Nov. 20, 2008

(51) Int. Cl.
*A63F 9/24* (2006.01)

(52) U.S. Cl. ..... 463/42; 463/43

(58) Field of Classification Search ..... 463/1, 40–42
See application file for complete search history.

(56) References Cited

U.S. PATENT DOCUMENTS

| | | | | |
|---|---|---|---|---|
| 6,203,433 | B1 | 3/2001 | Kume | |
| 6,293,866 | B1 | 9/2001 | Walker | |
| 6,345,297 | B1 | 2/2002 | Grimm | |
| 6,352,479 | B1 | 3/2002 | Sparks | |
| 6,631,522 | B1 * | 10/2003 | Erdelyi | 725/53 |
| 6,641,481 | B1 | 11/2003 | Mai | |
| 6,712,693 | B1 | 3/2004 | Hettinger | |
| 7,029,394 | B2 | 4/2006 | Leen | |
| 2004/0128319 | A1 | 7/2004 | Davis | |
| 2006/0121990 | A1 * | 6/2006 | O'Kelley et al. | 463/42 |
| 2006/0135264 | A1 * | 6/2006 | Shaw et al. | 463/42 |
| 2006/0194633 | A1 | 8/2006 | Paaulsen | |
| 2006/0242291 | A1 | 10/2006 | Nevalainen | |
| 2006/0287099 | A1 * | 12/2006 | Shaw et al. | 463/42 |

OTHER PUBLICATIONS

N. Burani and W. Zwicker "Coalition Formation Games with Separable Preferences" Universidad Autonoma de Barcelona, 1998.
J. Laird, "It Knows What You're Going To Do: Adding Anticipation to a Quakebot" University of Michigan, Mar. 2000.

* cited by examiner

*Primary Examiner* — David L Lewis
*Assistant Examiner* — Eric M Thomas
(74) *Attorney, Agent, or Firm* — Joseph R. Kelly; Westman, Champlin & Kelly, P.A.

(57) ABSTRACT

A network gaming service accesses attributes of a particular user to match the user to a gaming session with users having similar attributes. A game hosting service uses preferences of the users in a session and determines parameters for a match. Subsequent match parameters can be further determined based on a history for the session as well as each of the user's preferences.

18 Claims, 9 Drawing Sheets

700

702

704

| | Player 1 | Player 2 | Player 3 | Player 4 | Player 5 | Player 6 |
|---|---|---|---|---|---|---|
| Map 1 | | X | X | X | | X |
| Map 2 | | X | | X | | X |
| Map 3 | | X | X | | | X |
| Map 4 | | X | | X | | X |
| Map 5 | | X | X | | | X |
| Map 6 | | X | | X | | X |
| Map 7 | | X | | | X | X |
| Map 8 | | X | X | | | |
| Map 9 | | X | | | | X |
| Map 10 | | X | | | | |

GAME HOSTING SERVICE

BACKGROUND

Current gaming devices are enabled for network connectivity, which allows users to participate in multi-player games across a network. In these games, there are several selectable parameters for a number of players to participate in a particular match of the game. For instance, a real-time shooter game can have parameters such as a particular map, a particular game type, a number of players and/or a type of weapon. Likewise, a racing game can have parameters such as a particular track, a car class, a number of laps, a number of cars and/or weather. While these parameters can add variety and novelty to individual matches, they can also be a cause of a stalemate with regard to their selection. For instance, many players may argue over which parameters for which to play a subsequent match. Current game hosting services provide an automatic selection for only one parameter and do not take into account preferences of the users playing a particular match.

The discussion above is merely provided for general background information and is not intended to be used as an aid in determining the scope of the claimed subject matter.

SUMMARY

A network gaming service accesses attributes of a particular user to match the user to a gaming session with users having similar attributes. A game hosting service uses preferences of the users in a session and selects parameters for a match. Subsequent match parameters can be further selected based on a history for the session as well as each of the user's preferences.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
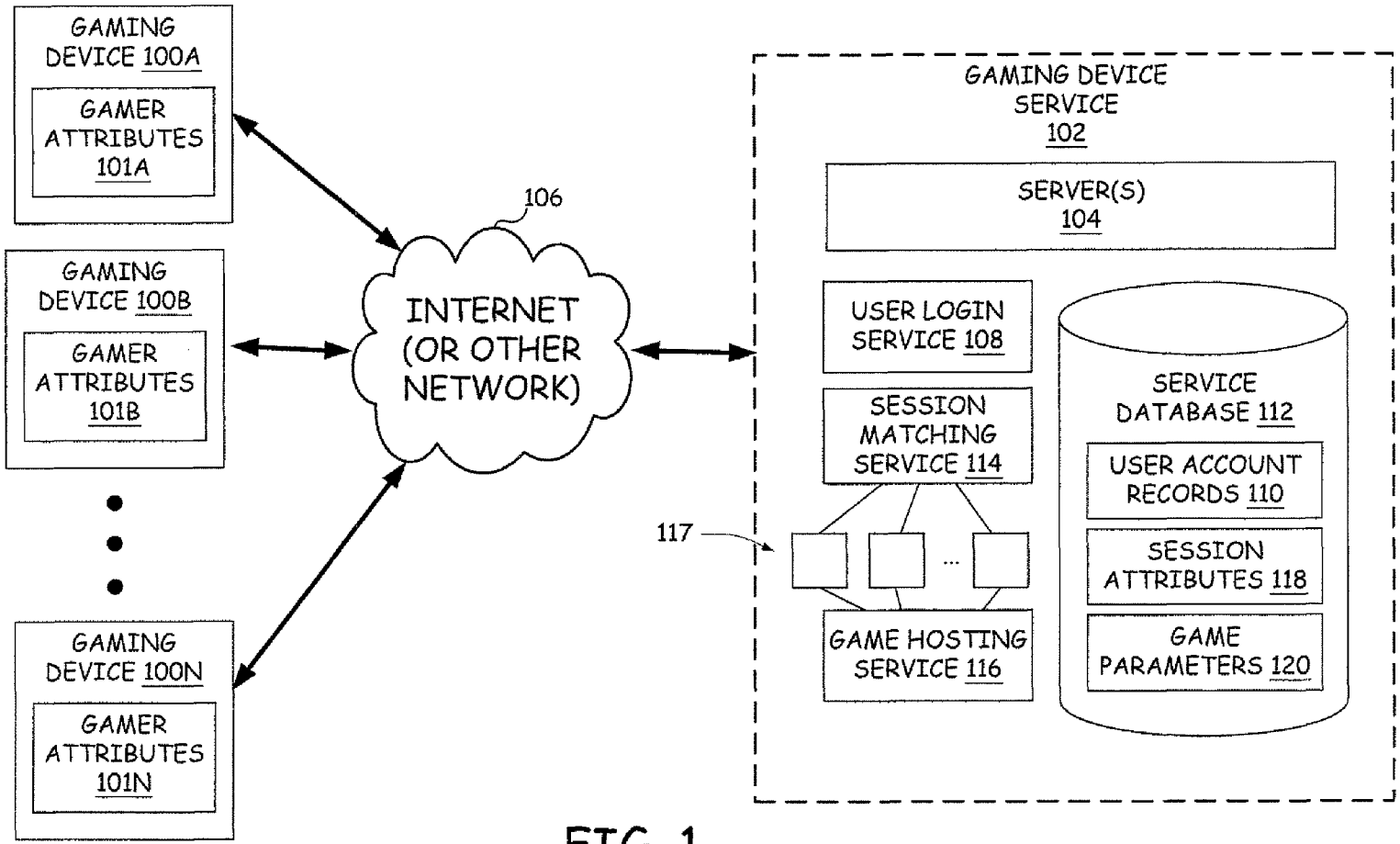
FIG. 1 is a block diagram of gaming devices networked with one or more servers.
Figure 2:
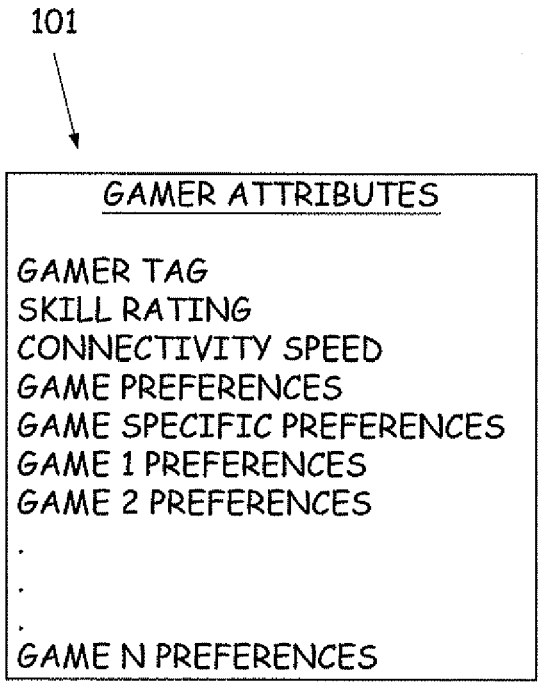
FIG. 2 is a list of gamer data attributes.

FIG. 1 is a block diagram of multiple gaming devices 100A-100N having individual gamer attributes 101A-101N, respectively, stored thereon. Although herein illustrated wherein gamer attributes 101A-101N are stored on a particular gaming device 100A-100N, gamer attributes can be stored remote from the gaming device 100A-100N. One or more users (also known as gamers or players) operates one of the gaming devices 100 for interaction with other users. A list of exemplary gamer attributes 101 is provided in FIG. 2.

Several of these attributes can be utilized when interacting with gaming device service 102. The gaming devices 100A-100N are networked with the gaming device service 102 having one or more servers 104 through a network 106. Under one embodiment, network 106 comprises the internet. Server (s) 104 include a communication component capable of receiving information from and transmitting information to gaming devices 100A-100N and provide a collection of services that applications running on gaming devices 100A-100N may invoke and utilize.

For example, gaming devices 100A-100N may invoke user login service 108, which is used to authenticate a user on gaming devices 100A-100N. During login, login service 108 obtains a gamer tag (an identifier associated with a user) and a password from the user as well as a device identifier that uniquely identifies the device that the user is using and a network path to the device. The gamer tag and password are authenticated by comparing them to user records 110 and a database 112, which may be located on the same server as user login service 108 or may be distributed on a different server or a collection of different servers, Once authenticated, user login service 108 stores the device identifier and the network path in user records 110 so that messages and information may be sent to the device.

Gaming devices 100A-100N can further utilize session matching service 114 and game hosting service 116 for participating in multi-player matches of particular games. Multi-player matches involve a number of users that participate in a competition based on a number of different parameters. Users can compete against each other or in teams to perform a particular objective. Session matching service 114 utilizes gamer attributes 101 to match users to a particular session in which other users have similar attributes. Once in a session, game hosting service 116 can utilize gamer attributes 101 in maximizing user preferences while providing variety for different matches.

One type of game that provides multi-player capabilities is a real-time shooter game. One real-time shooter game is Halo®, provided by Microsoft Corporation of Redmond, Wash. Halo® includes several parameter categories for matches including map, game type, weapons, vehicles, duration, etc. One parameter from each category is selected to form a parameter set that can be used to conduct a match. Once a particular match is complete, one or more of the parameters in the parameter set can be altered by game hosting service 116 for a subsequent match to provide variety within a session. The parameters can be altered automatically and independent of further user input to decrease the amount of time spent between matches. A prediction of what parameters are to be used is subsequent matches can be made during a current match to aid in matching users to a particular session.

Another type of game that also includes multi-player matches is a racing game in which users operate a simulated vehicle in a race. There are also several parameter categories for operating a race such as car class, number of laps, track, weather, etc. Parameters from each of the categories can be selected to perform a race. Once the race is complete, these parameters can also be altered to provide different race scenarios. Other games and types of games can further be utilized by session matching service 114 and game hosting service 116, as appreciated by those skilled in the art. These types of games can be classified in various genres, which can include, but are not limited to, sports, action, role-playing, adventure, simulation, strategy, arcade, fighting, etc.

Figure 3:
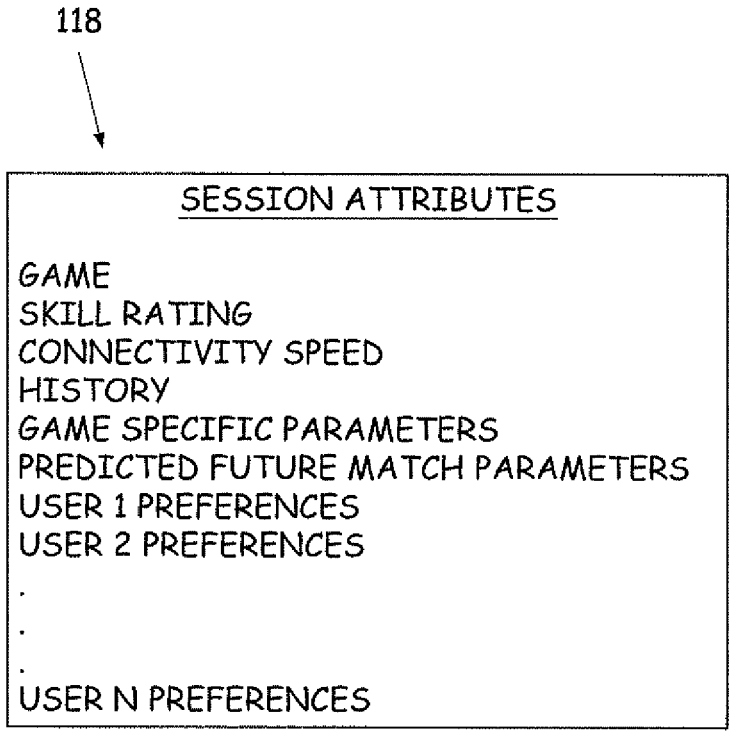
FIG. 3 is a list of session attributes.

Session matching service 114 matches users to a number of different sessions 117. Sessions 117 are then administered by game hosting service 116. Each session 117 includes session attributes 118 that are also stored in service database 112. These session attributes 118 can include a variety of different attributes that are game independent and game specific such as skill level, connectivity speed, game specific parameters, number of players, history, user preferences, predicted future match parameters, etc. FIG. 3 is a list of exemplary session attributes 118.

Based on gamer attributes 101A-101N, session matching service 114 can match users to particular sessions based on the attributes of each user. It is worth noting that the match can be made on one attribute or a plurality of different attributes. For example, a user can be matched to a session based on a number of maps that the user prefers. Alternatively, or in addition to, the user can be matched on a plurality of attributes such as map, game type and connectivity speed. For sessions that are conducting an active match, a prediction of future match parameters can be made for use in matching a user to a session. For example, a user may choose to join a session with an upcoming match that uses a particular map. The predicted future match parameters for all sessions can further be assembled such that a user is presented with substantial variety when choosing which particular session to join.

Figure 4:
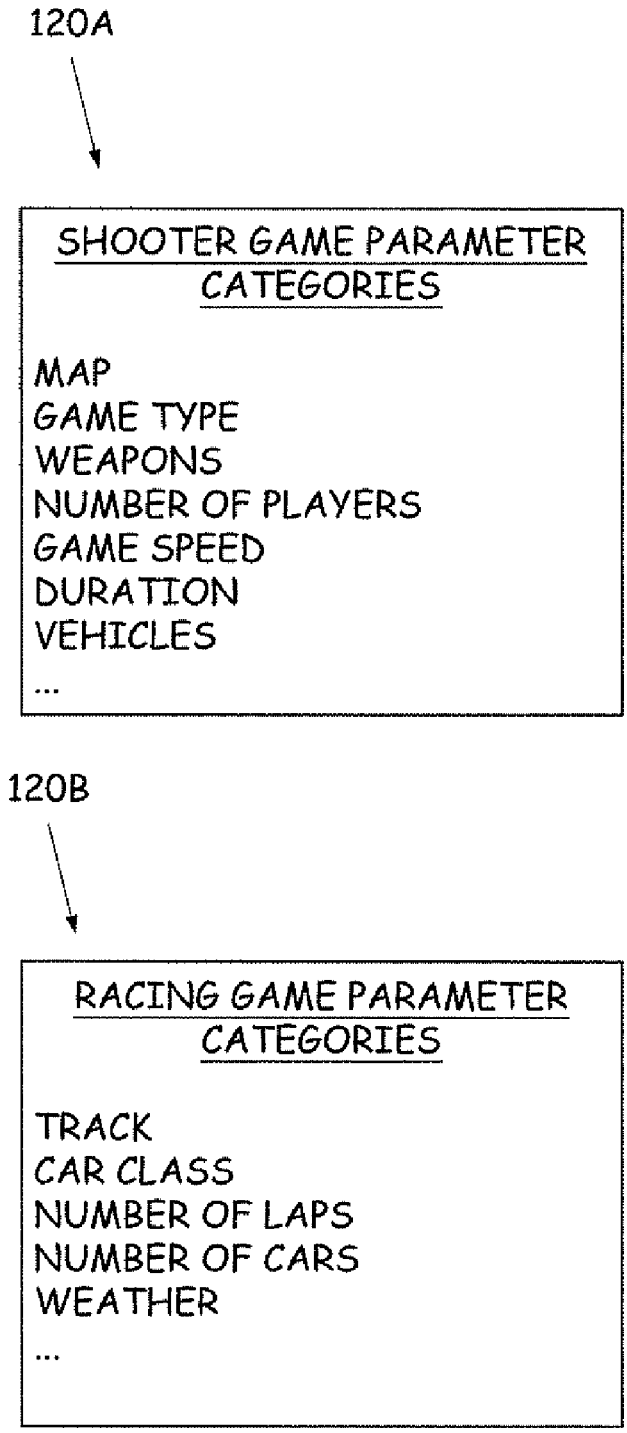
FIG. 4 is a list of game parameter categories for two different games.

Once in a session, game hosting service 116 can be utilized to maximize user preferences as well as provide a variety of different gaming parameters within the particular session. For example, game hosting service 116 can maintain a history of each session to provide adequate variety of different parameters. To facilitate a session, game hosting service 116 accesses garner attributes 101 and game parameters 120. Game parameters 120 are stored in service database 112 and include parameter categories for a particular game in a session being facilitated by game hosting service 116. For example, in a real-time shooter game, the game parameter categories can include a map, game type, weapons, number of players, game speed, duration, etc. In a racing game, the game parameter categories can include a track, a car class, a number of laps, a number of cars, weather, etc. FIG. 4 lists game parameter categories for a real-time shooter game (120A) and a racing game (120B).

Figures 5, 7:
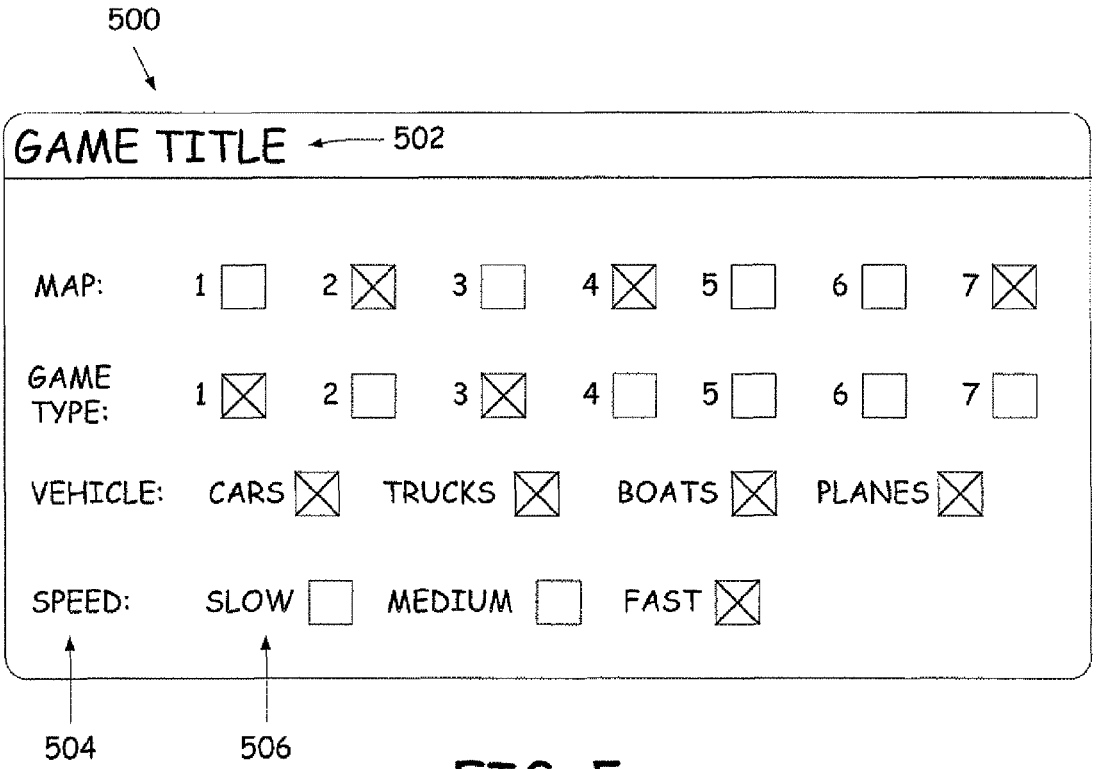
FIG. 5 is a diagram of a user interface for identifying preferences of game specific parameters.
FIG. 7 is a table of players and selected parameters.

FIG. 5 is an exemplary user interface 500 that can be accessed by a user for selecting game specific preferences from the game parameters. Interface 500 includes a game title 502, a list of parameter categories 504 and a preference selection section 506. In the embodiment illustrated, the preference categories in list 504 include map, game type, vehicle and speed. List 504 is intended to be illustrative only and other categories can also be used. Section 506 is used to select particular parameters within the categories to indicate that the user prefers that particular preference. For example, a user can select among seven different maps, seven different game types, four different vehicles and three different speeds. Each parameter is associated with its own selection box that a user can alter by placing an "X" in the box or removing an "X" therefrom. Other selection mechanisms can also be used, as desired. Additionally, restraints can be placed on selections within section 506. For example, a user may be only able to select one speed from the three different speeds. Once these selections are mode, they can be transmitted to game service 102 or otherwise stored for access by game hosting service 116.

Figure 6:
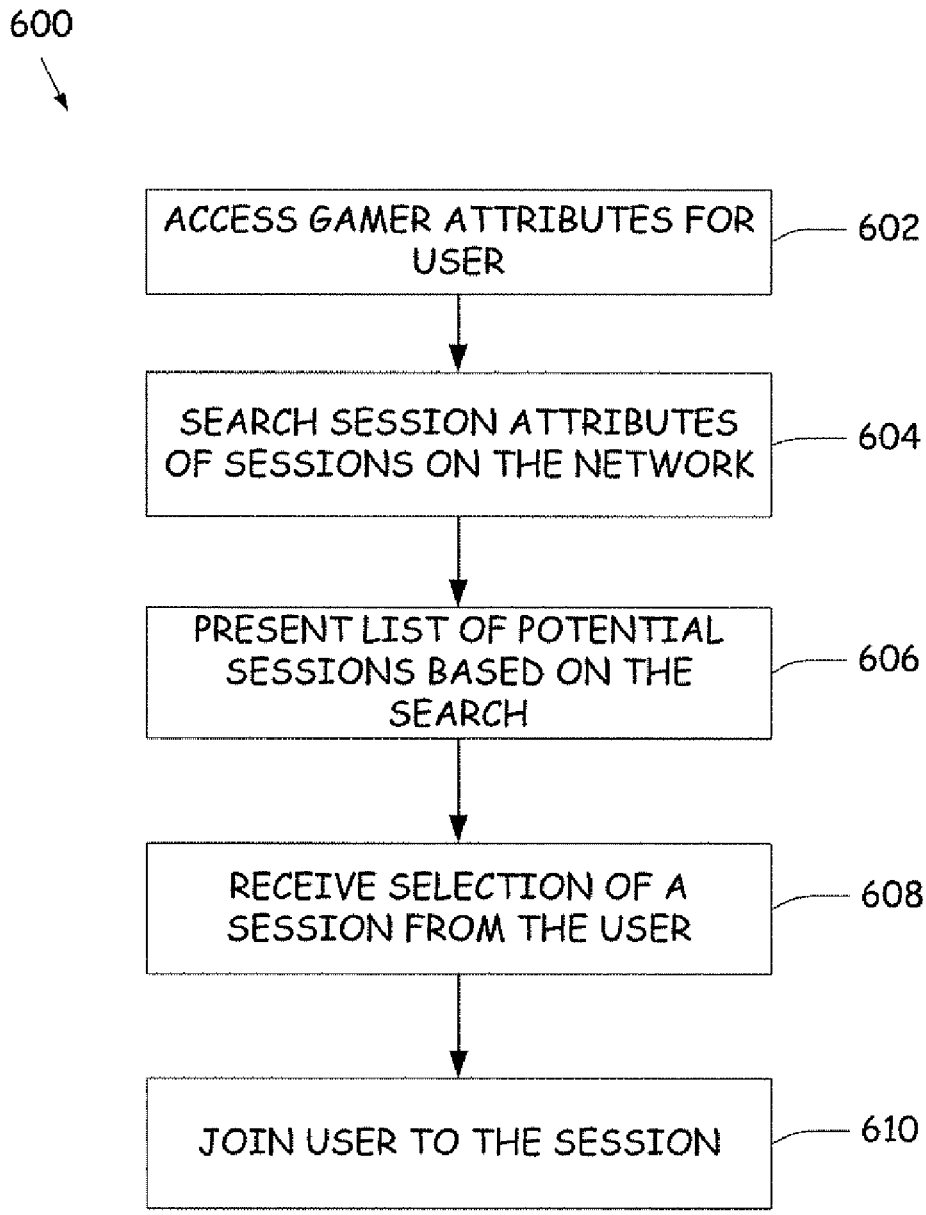
FIG. 6 is a flow diagram of a method for matching a user to a session.

FIG. 6 is a flow diagram of a method 600 that can be performed by session matching service 114 for matching a user to a particular session based on preferences from a user that have been selected, for example by using user interface 500. After a user has logged into gaming device service 102, the user can choose from a plurality of sessions 117 for which to join. Session matching service 114 is utilized to match the user using gamer attributes 101 to a particular session. Method 600 beings at step 602 wherein the attributes for the gamer are accessed. These attributes can include both game independent attributes, such as a gamer's skill rating and connectivity speed, as well as game specific preferences such as a particular map, game type, car class, weather, etc.

At step 604, the sessions 117 of other users on the network can be searched in order to match the current user's attributes to sessions where other players have similar attributes. This search can be performed automatically such that the user need not provide further input for which to locate sessions that include other users with similar attributes and/or preferences. For example, a user may have indicated that the user prefers four particular maps out of ten possible maps in a game. Session matching service can determine players that prefer the same or similar maps based on the user's selected preferences. Alternatively, or in addition to, the user may be operating with a fast network connection and should be paired with other users having a similar connection speed. As discussed above, the match can be made using a single attribute or based on multiple attributes that can include predicted future match parameters. The search can also be dependent on a single game or on multiple different games.

At step 606, a list of potential sessions can be presented to a user based on the attributes and a search of the available sessions. The list can be provided in a user interface such that the user can easily select one of the sessions to join. As discussed above, the list can include predicted future map parameters such that the user can choose a session with particular future parameters. If the predicted future match parameters are assembled for a plurality of sessions, the parameters can be managed to ensure variety for the plurality of sessions to give the user several options for joining a current session. At step 608, a selection of a particular session is received from the user. At step 610, the user is joined to the selected session. Once in a session, game preferences of users in the session drive game hosting service 116 are used to select parameters for matches in the session.

FIG. 7 is a table 700 used by game hosting service 116 to select particular parameters for a parameter category for matches within a session. Table 700 is used to automatically determine parameters for matches to prevent undesired lag time between matches and negotiations over match parameters. Table 700 includes a plurality of columns 702 and a plurality of rows 704. The plurality of columns 702 lists each player in the session, in this case players 1-6. The plurality of rows 704 lists each map for a game, in this case maps 1-10. Using table 700, a determination of what maps are popular among the session players can be made. Map 1 is the most popular map, having four players that prefer it. Maps 2-7 each have three players prefer it, maps 8-9 have two players that prefer it and map 10 includes only one player that prefers it. In subsequent matches, parameters are automatically altered based on a session history and the user preferences. The voting system provides one example of determining parameters for matches. Other approaches can also be used, such as wherein players can provide a ranking of particular parameters such that certain parameters are weighted more heavily, etc.

In one example, a voting system is used to select parameters for a match and subsequent matches. The voting system can be employed for each parameter category and be used in determining predicted future match parameters. In the voting system, each player has one vote for each category, being either a positive preference or no preference. For each parameter, the number of votes are added to determine popularity of each parameter. For instance, map 1 could be used in an initial match, since it has the most "votes". This voting system can minimize effect from players not discriminating among parameters and can prevent users from exhibiting a disproportionate amount of influence over selection of parameters. In table 700, player 1 has not indicated preferences for any map while player 2 has a preference for all maps. This lack of discrimination does not have an impact on the determination of parameters for a match. Furthermore, player 5 only prefers one map. While this selection provides some influence in determining the map for a match (by providing one vote for map 7), the influence is not disproportionate with respect to the rest of the players in the session.

Figure 8:
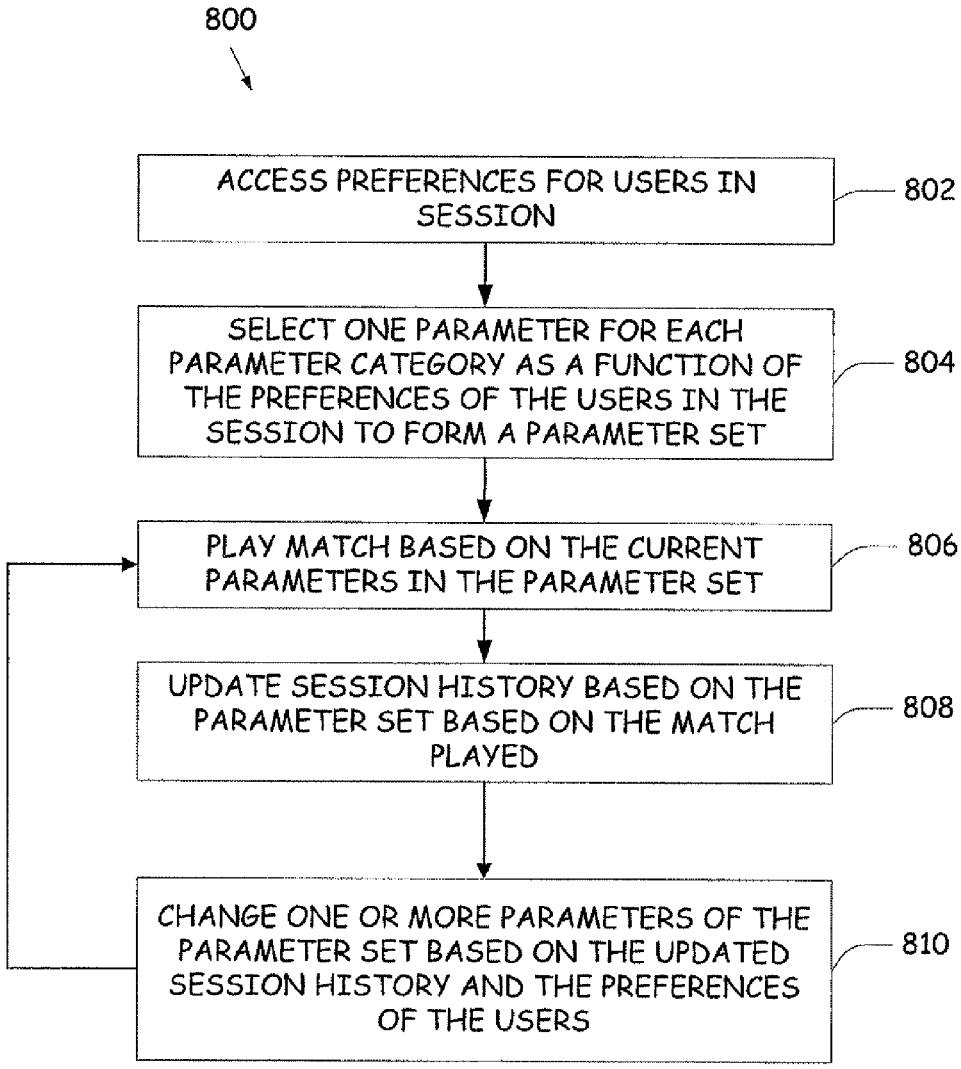
FIG. 8 is a flow diagram of a method for providing automatic game hosting.

FIG. 8 is a flow diagram of a method 800 for automatically hosting matches of games within a session. Method 800 beings at step 802 wherein preferences for users in a session are accessed. For example, the preferences can be stored in a table such as table 700 of FIG. 7. At step 804, one parameter from each category are selected as a function of the preferences of the users in the session to form a parameter set. In FIG. 7, since map 1 is the most popular map, map 1 can be used as one of the parameters in the parameter set for the first match in the session. Other parameters for other categories can be determined similarly. Once the parameter set is complete, the match is played based on the current parameters in the set at step 806. During the match, predicted future match parameters can be determined to be used by session matching service 114 and/or game hosting service 116. After the match has been played, the session history is updated at step 808. The session history can place weights on parameters that have just been used in the previous match. For example, if map 1 has been used, the sessions history can be updated such that map 1 is not used again until a number of matches have been played, for example three or four matches.

At step 810, one or more parameters of the parameter set are changed based on the updated session history and the preferences of the users. The parameter set could also be updated automatically based on the predicted future match parameters. Given the table in FIG. 7, one of maps 2-7 can be chosen, since these are the next most popular maps of the users in the session. Other parameters can also be changed at this point, for example for the categories game type, duration, vehicles, etc. based on the preferences of users in the session. After changing the parameters, method 800 returns to step 806 wherein the match is played based on the changed parameters. The changing of parameters and beginning of a new match can be performed automatically and independent of further input from the users such that there is not an unacceptable amount of time between matches and such that arguing amongst users what parameters should be used can be avoided. Method 800 can then proceed through steps 806, 808 and 810 for further matches as many times as desired by players within the session.

Figure 9:
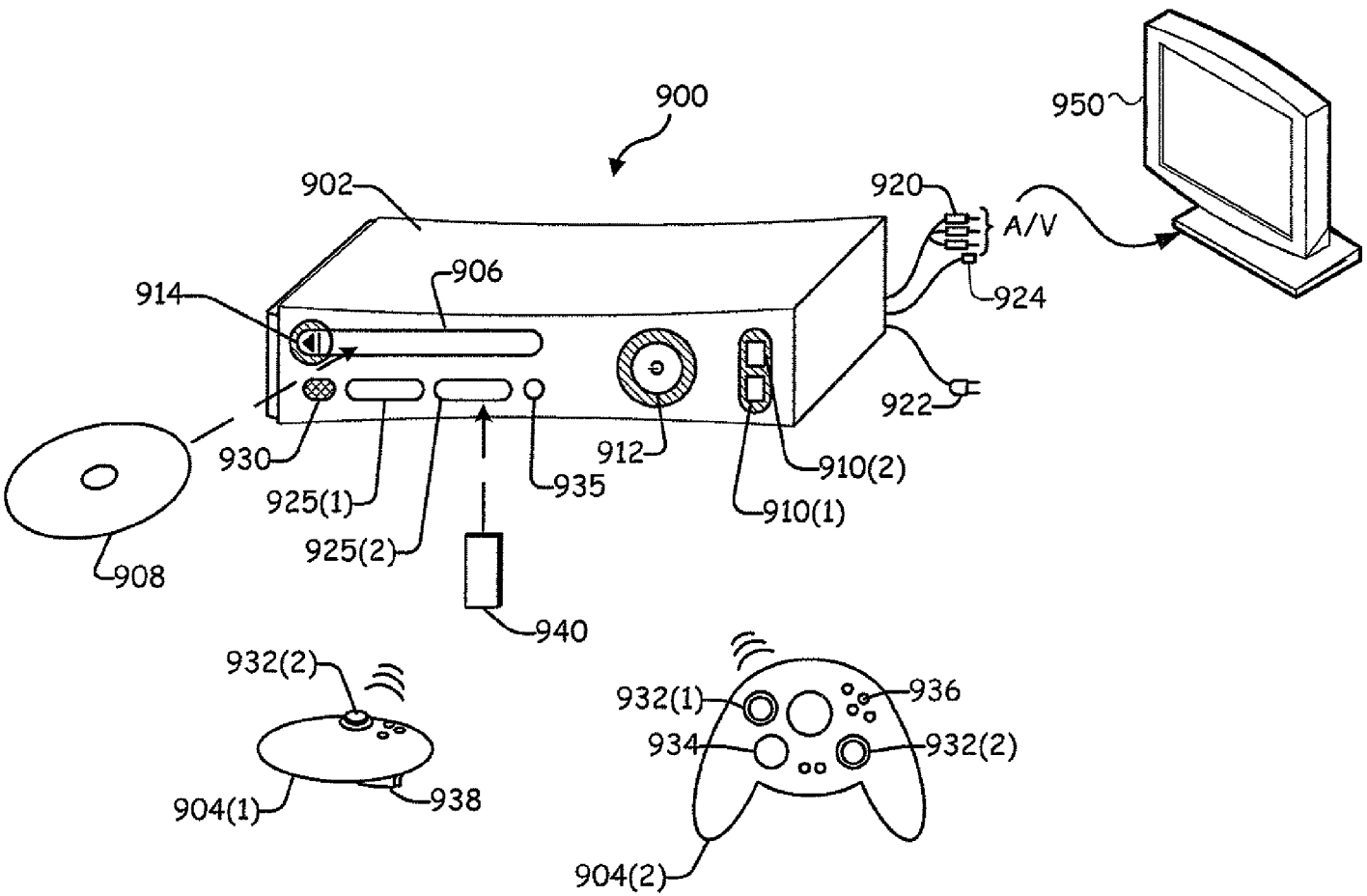
FIG. 9 is a diagram of external components of a gaming system.
Figure 10:
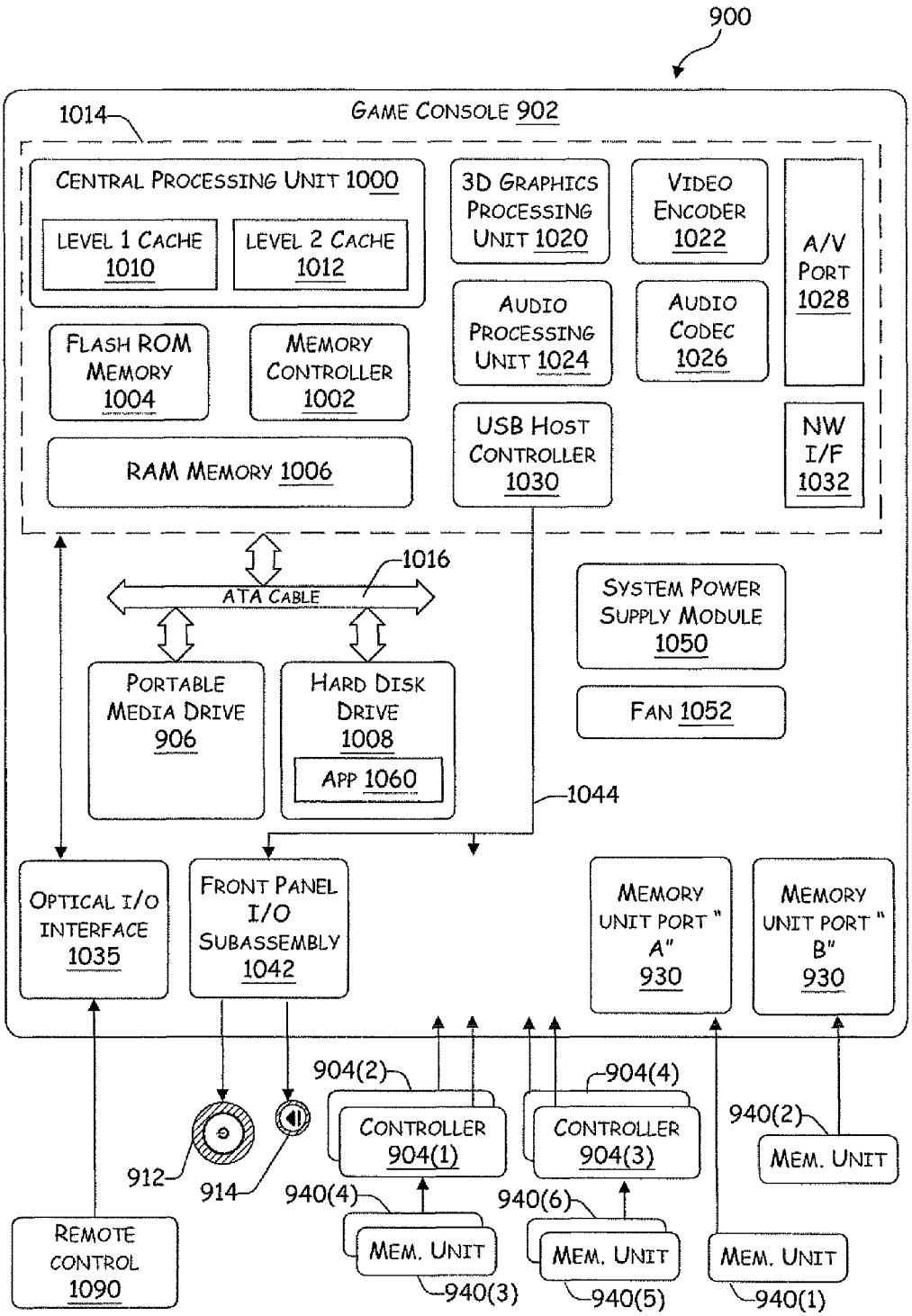
FIG. 10 is a block diagram of internal components of a gaming system.

Concepts presented above can be implemented in a number of different environments. These environments can include several types of devices as discussed below. FIGS. 9 and 10 describe a gaming and media system while FIG. 11 describes a general computing environment. The devices below are exemplary only, and other devices and environments can be used with respect to the concepts presented herein.

FIG. 9 shows an exemplary gaming and media system 900 that can be used as one or more of the gaming devices 100A-100N. As shown in FIG. 9, gaming and media system 900 includes a game and media console (hereinafter "console") 902. In general, console 902 is one type of computing system, as will be further described below. Console 902 is configured to accommodate one or more wireless controllers, as represented by controllers 904(1) and 904(2). Console 902 is equipped with an internal hard disk drive (not shown) and a portable media drive 906 that supports various forms of portable storage media, as represented by optical storage disc 908. Examples of suitable portable storage media include DVD, CD-ROM, game discs, and so forth. Console 902 also includes two memory unit card receptacles 925(1) and 925 (2), for receiving removable flash-type memory units 940. A command button 935 on console 902 enables and disables wireless peripheral support.

As depicted in FIG. 9, console 902 also includes an optical port 930 for communicating wirelessly with one or more devices and two USB (Universal Serial Bus) ports 910(1) and 910(2) to support a wired connection for additional controllers, or other peripherals. In some implementations, the number and arrangement of additional ports may be modified. A power button 912 and an eject button 914 are also positioned on the front face of game console 902. Power button 912 is selected to apply power to the game console, and can also provide access to other features and controls, and eject button 914 alternately opens and closes the tray of a portable media drive 906 to enable insertion and extraction of a storage disc 908.

Console 902 connects to a television or other display (not shown) via A/V interfacing cables 920. In one implementation, console 902 is equipped with a dedicated A/V port (not shown) configured for content-secured digital communication using A/V cables 920 (e.g., A/V cables suitable for coupling to a High Definition Multimedia Interface "HDMI" port on a high definition monitor 950 or other display device). A power cable 922 provides power to the game console. Console 902 may be further configured with broadband capabilities, as represented by a cable or modem connector 924 to facilitate access to a network, such as the Internet. The broadband capabilities can also be provided wirelessly, through a broadband network such as a wireless fidelity (Wi-Fi) network.

Each controller 904 is coupled to console 902 via a wired or wireless interface. In the illustrated implementation, the controllers are USB-compatible and are coupled to console 902 via a wireless or USB port 910. Console 902 may be equipped with any of a wide variety of user interaction mechanisms. In an example illustrated in FIG. 9, each controller 904 is equipped with two thumbsticks 932(1) and 932(2), a D-pad 934, buttons 936, and two triggers 938. These controllers are merely representative, and other known gaming controllers may be substituted for, or added to, those shown in FIG. 9.

In one implementation (not shown), a memory unit (MU) 940 may also be inserted into console 900 to provide additional and portable storage. Portable MUs enable users to store game parameters for use when playing on other consoles. In this implementation, each controller is configured to accommodate two MUs 940, although more or less than two MUs may also be employed.

Gaming and media system 900 is generally configured for playing games stored on a memory medium, as well as for downloading and playing games, and reproducing pre-recorded music and videos, from both electronic and hard media sources. With the different storage offerings, titles can be played from the hard disk drive, from optical disk media (e.g., 908), from an online source, or from MU 940. A sample of the types of media that gaming and media system 900 is capable of playing include:

Game titles played from CD and DVD discs, from the hard disk drive, or from an online source.

Digital music played from a CD in portable media drive 906, from a file on the hard disk drive (e.g., music in the Windows Media Audio (WMA) format), or from online streaming sources.

Digital audio/video played from a DVD disc in portable media drive 906, from a file on the hard disk drive (e.g., Active Streaming Format), or from online streaming sources.

FIG. 10 is a functional block diagram of gaming and media system 900 and shows functional components of gaming and media system 900 in more detail. Console 902 has a central processing unit (CPU) 1000, and a memory controller 1002 that facilitates processor access to various types of memory, including a flash Read Only Memory (ROM) 1004, a Random Access Memory (RAM) 1006, a hard disk drive 1008, and portable media drive 906. In one implementation, CPU 1000 includes a level 1 cache 1010, and a level 2 cache 1012 to temporarily store data and hence reduce the number of memory access cycles made to the hard drive 1008, thereby improving processing speed and throughput.

CPU 1000, memory controller 1002, and various memory devices are interconnected via one or more buses (not shown). The details of the bus that is used in this implementation are not particularly relevant to understanding the subject matter of interest being discussed herein. However, it will be understood that such a bus might include one or more of serial and parallel buses, a memory bus, a peripheral bus, and a processor or local bus, using any of a variety of bus architectures. By way of example, such architectures can include an Industry Standard Architecture (ISA) bus, a Micro Channel Architecture (MCA) bus, an Enhanced ISA (EISA) bus, a Video Electronics Standards Association (VESA) local bus, and a Peripheral Component Interconnects (PCI) bus also known as a Mezzanine bus.

In one implementation, CPU 1000, memory controller 1002, ROM 1004, and RAM 1006 are integrated onto a common module 1014. In this implementation, ROM 1004 is configured as a flash ROM that is connected to memory controller 1002 via a Peripheral Component Interconnect (PCI) bus and a ROM bus (neither of which are shown). RAM 1006 is configured as multiple Double Data Rate Synchronous Dynamic RAM (DDR SDRAM) modules that are independently controlled by memory controller 1002 via separate buses (not shown). Hard disk drive 1008 and portable media drive 906 are shown connected to the memory controller via the PCI bus and an AT Attachment (ATA) bus 1016. However, in other implementations, dedicated data bus structures of different types can also be applied in the alternative.

A three-dimensional graphics processing unit 1020 and a video encoder 1022 form a video processing pipeline for high speed and high resolution (e.g., High Definition) graphics processing. Data are carried from graphics processing unit 1020 to video encoder 1022 via a digital video bus (not shown). An audio processing unit 1024 and an audio codec (coder/decoder) 1026 form a corresponding audio processing pipeline for multi-channel audio processing of various digital audio formats. Audio data are carried between audio processing unit 1024 and audio codec 1026 via a communication link (not shown). The video and audio processing pipelines output data to an A/V (audio/video) port 1028 for transmission to a television or other display. In the illustrated implementation, video and audio processing components 1020-1028 are mounted on module 1014.

FIG. 10 shows module 1014 including a USB host controller 1030 and a network interface 1032. USB host controller 1030 is shown in communication with CPU 1000 and memory controller 1002 via a bus (e.g., PCI bus) and serves as host for peripheral controllers 904(1)-904(4). Network interface 1032 provides access to a network (e.g., Internet, home network, etc.) and may be any of a wide variety of various wire or wireless interface components including an Ethernet card, a modem, a wireless access card, a Bluetooth module, a cable modem, and the like.

In the implementation depicted in FIG. 10, console 902 includes a controller support subassembly 1040 for supporting four controllers 904(1)-904(4). The controller support subassembly 1040 includes any hardware and software components needed to support wired and wireless operation with an external control device, such as for example, a media and game controller. A front panel I/O subassembly 1042 supports the multiple functionalities of power button 912, the eject button 914, as well as any LEDs (light emitting diodes) or other indicators exposed on the outer surface of console 902. Subassemblies 1040 and 1042 are in communication with module 1014 via one or more cable assemblies 1044. In other implementations, console 902 can include additional controller subassemblies. The illustrated implementation also shows an optical I/O interface 1035 that is configured to send and receive signals that can be communicated to module 1014.

MUs 940(1) and 940(2) are illustrated as being connectable to MU ports "A" 930(1) and "B" 930(2) respectively. Additional MUs (e.g., MUs 940(3)-940(6)) are illustrated as being connectable to controllers 904(1) and 904(3), i.e., two MUs for each controller. Controllers 904(2) and 904(4) can also be configured to receive MUs (not shown). Each MU 940 offers additional storage on which games, game parameters, and other data may be stored. In some implementations, the other data can include any of a digital game component, an executable gaming application, an instruction set for expanding a gaming application, and a media file. When inserted into console 902 or a controller, MU 940 can be accessed by memory controller 1002.

A system power supply module 1050 provides power to the components of gaming system 900. A fan 1052 cools the circuitry within console 902.

An application 1060 comprising machine instructions is stored on hard disk drive 1008. When console 902 is powered on, various portions of application 1060 are loaded into RAM 1006, and/or caches 1010 and 1012, for execution on CPU 1000, wherein application 1060 is one such example. Various applications can be stored on hard disk drive 1008 for execution on CPU 1000.

Gaming and media system 900 may be operated as a standalone system by simply connecting the system to monitor 950 (FIG. 9), a television, a video projector, or other display device. In this standalone mode, gaming and media system 900 enables one or more players to play games, or enjoy digital media, e.g., by watching movies, or listening to music. However, with the integration of broadband connectivity made available through network interface 1032, gaming and media system 900 may further be operated as a participant in a larger network gaming community, as discussed above in connection with FIG. 1.

Figure 11:
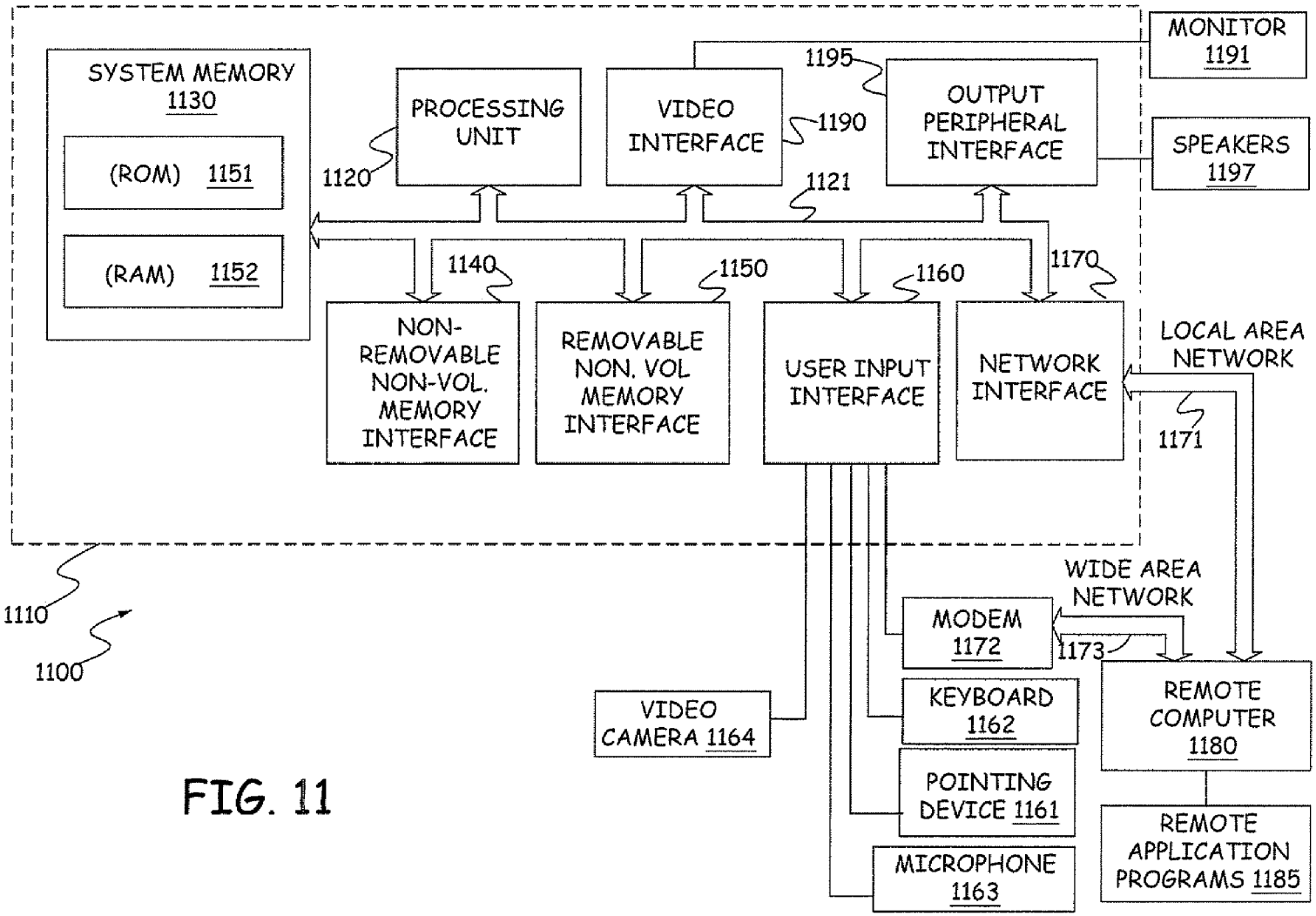
FIG. 11 is a block diagram of a general computing environment.

FIG. 11 is a block diagram of a general computing environment. In FIG. 11, the computing system environment 1100 is only one example of a suitable computing environment and is not intended to suggest any limitation as to the scope of use or functionality of the claimed subject matter. Neither should the computing environment 1100 be interpreted as having any dependency or requirement relating to any one or combination of components illustrated in the exemplary computing environment 1100.

Computing environment 1100 illustrates a general purpose computing system environment or configuration. Examples of well-known computing systems, environments, and/or configurations that may be suitable for use with the service agent or a client device include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

Concepts presented herein may be described in the general context of computer-executable instructions, such as program modules, being executed by a computer. Generally, program modules include routines, programs, objects, components, data structures, etc. that perform particular tasks or implement particular abstract data types. Some embodiments are designed to be practiced in distributed computing environments where tasks are performed by remote processing devices that are linked through a communications network. In a distributed computing environment, program modules are located in both local and remote computer storage media including memory storage devices.

Exemplary environment 1100 for implementing the above embodiments includes a general-purpose computing system or device in the form of a computer 1110. Computer 1110 can be used as one or more of the gaming devices 100A-100N and/or as one or more of the servers 104. Components of computer 1110 may include, but are not limited to, a processing unit 1120, a system memory 1130, and a system bus 1121 that couples various system components including the system memory to the processing unit 1120. The system bus 1121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 1110 typically includes a variety of computer readable media. Computer readable media can be any available media that can be accessed by computer 1110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data.

The system memory 1130 includes computer storage media in the form of volatile and/or nonvolatile memory such as read only memory (ROM) 1131 and random access memory (RAM) 1132. The computer 1110 may also include other removable/non-removable volatile/nonvolatile computer storage media. Non-removable non-volatile storage media are typically connected to the system bus 1121 through a non-removable memory interface such as interface 1140. Removable non-volatile storage media are typically connected to the system bus 1121 by a removable memory interface, such as interface 1150.

A user may enter commands and information into the computer 1110 through input devices such as a keyboard 1162, a microphone 1163, a pointing device 1161, such as a mouse, trackball, game controller, joystick or touch pad, and a video camera 1164. These and other input devices are often connected to the processing unit 1120 through a user input interface 1160 that is coupled to the system bus, but may be connected by other interface and bus structures, such as a parallel port or a universal serial bus (USB). A monitor 1191 or other type of display device is also connected to the system bus 1121 via an interface, such as a video interface 1190. In addition to the monitor, computer 1110 may also include other peripheral output devices such as speakers 1197, which may be connected through an output peripheral interface 1195.

The computer 1110, when implemented as a client device or as a service agent, is operated in a networked environment using logical connections to one or more remote computers, such as a remote computer 1180. The remote computer 1180 may be a personal computer, a hand-held device, a server, a router, a network PC, a peer device or other common network node, and typically includes many or all of the elements described above relative to the computer 1110. The logical connections depicted in FIG. 11 include a local area network (LAN) 1171 and a wide area network (WAN) 1173, but may also include other networks. Such networking environments are commonplace in offices, enterprise-wide computer networks, intranets and the Internet.

When used in a LAN networking environment, the computer 1110 is connected to the LAN 1171 through a network interface or adapter 1170. When used in a WAN networking environment, the computer 1110 typically includes a modem 1172 or other means for establishing communications over the WAN 1173, such as the Internet. The modem 1172, which may be internal or external, may be connected to the system bus 1121 via the user input interface 1160, or other appropriate mechanism. In a networked environment, program modules depicted relative to the computer 1110, or portions thereof, may be stored in the remote memory storage device. By way of example, and not limitation, FIG. 11 illustrates remote application programs 1185 as residing on remote computer 1180. It will be appreciated that the network connections shown are exemplary and other means of establishing a communications link between computers may be used.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A computer implemented method for providing a gaming service for a plurality of users in a gaming session, the method comprising:

identifying a plurality of game parameter categories for a game to be played by the plurality of users in the gaming session, each game parameter category including a plurality of selectable game parameters;

updating a session history based on a first game parameter set of a first match of the game, the first game parameter set including selected game parameters from the plurality of game parameter categories used in conducting the first match;

accessing stored game preferences from the plurality of users in the gaming session, the game preferences indicating at least some of the selectable game parameters that each of the plurality of users prefer;

forming a second game parameter set that is different than the first game parameter set by selecting one game parameter in each of the plurality of game parameter categories as a function of the stored game preferences and the session history; and conducting a second match of the game to be played among the plurality of users subsequent to the first match using the second game parameter set.

2. The method of claim 1, wherein the session history is indicative of the selectable game parameters from the plurality of game parameter categories that were used in conducting one or more matches of the game prior to the second match, and wherein forming the second game parameter set comprises:

identifying a set of game parameters in each of the plurality of game parameter categories, the set of game parameters in each game parameter category excluding game parameters from the first game parameter set; and selecting the second game parameter set from the identified set of game parameters.

3. The method of claim 1 and further comprising:

changing at least one of the parameters of the second game parameter set to form a third game parameter set; and conducting a third match, following the second match, based on the third parameter set.

4. The method of claim 3 and further comprising:

updating the session history based on the second parameter set and the third parameter set; and changing at least one of the parameters in the third parameter set based on the session history and the game preferences.

5. The method of claim 3 wherein conducting the second match is performed automatically upon completion of the first match and independent of input from the plurality of users.

6. The method of claim 1 and further comprising:

connecting each of the plurality of users to the game service across a computer network; and receiving the game preferences with the game service from the network.

7. A computer implemented method for operating a gaming service, the method comprising:

connecting a user to the gaming service through a computer network;

accessing stored gamer attributes of the user, the gamer attributes including game independent attributes as well as game specific preferences indicating that the user prefers parameters of a game from a plurality of parameter categories;

identifying a plurality of sessions in the gaming service, each session including a game and a plurality of users for conducting a match of the game, each game having a plurality of maps associated therewith;

comparing the gamer attributes to session attributes for the plurality of sessions, the session attributes including game independent attributes and game specific preferences for the plurality of users in each session;

providing a list of sessions to the user that correspond to a match between at least one gamer attribute and at least one session attribute;

joining the user to a particular session, of the plurality of sessions, in which the plurality of users are playing with a given map of a given game, as a function of a user selection;

upon completion of the given map in the given game in the particular session, automatically selecting a next map for the given game based on the game independent attributes and game specific preferences of all of the plurality of the users in the particular session, including a history parameter that temporarily reduces a chance that the given map will also be selected as the next map; and automatically loading the automatically selected next map independently of further user input.

8. The method of claim 7 and further comprising:

identifying a plurality of parameter categories for a particular game of the particular session, each parameter category including a plurality of selectable parameters;

accessing game preferences from each of the users in the particular session indicative of preferences for the selectable parameters;

selecting one parameter in each parameter category as a function of the game preferences to form a parameter set; and conducting a match of the game in the particular session using the parameter set.

9. The method of claim 8 wherein automatically selecting a next map comprises:

updating a session history for the particular session based on the parameter set of the match; and forming a subsequent parameter set for a subsequent match as a function of the gamer preferences and the session history.

10. The method of claim 9 wherein automatically selecting a next map comprises:

changing at least one of the parameters of the parameter set to form a second parameter set; and conducting a second match in the particular session based on the second parameter set to identify the next map.

11. The method of claim 10 and further comprising continuing to automatically select subsequent maps by:

updating a session history for the particular session based on the first parameter set and the second parameter set; and changing at least one of the parameters in the second parameter set based on the session history and the game preferences.

12. The method of claim 10 wherein conducting the second match is performed automatically upon completion of the first-mentioned match and independent of input from users in the particular session.

13. A gaming device service operable in a computer network, comprising:

a plurality of sessions, each session including a game capable of conducting a multi-player match;

a session matching service adapted to access stored gamer attributes of a plurality of users and join each of the users to one of the plurality of sessions based on the gamer attributes, each of the gamer attributes including game independent attributes as well as game specific preferences indicating what each of the plurality of users prefers; and a game hosting service configured to:

select one game parameter in each of a plurality of game parameter categories of a game for each session as a function of game preferences of users in each session to form a first game parameter set, each of the game parameter categories including a plurality of selectable game parameters;

conduct a first match of the game based on the first game parameter set;

update a session history based on the first game parameter set of the first match; and form a predicted subsequent game parameter set for a second, subsequent match of the game by selecting one game parameter in each of the plurality of game parameter categories as a function of the game preferences and the session history, the game hosting service using the session history to weight parameters in the first parameter set relative to other ones of the plurality of selectable game parameters to reduce a likelihood that the subsequent game parameter set includes the same parameters as the first game parameter set.

14. The gaming device service of claim 13 wherein the game hosting service is further adapted to update the session history parameter based on the first parameter set and the subsequent parameter set and change at least one of the parameters in the subsequent parameter set based on the session history and the game preferences.

15. The gaming device service of claim 13 wherein conducting the subsequent match is performed automatically prior to completion of the first match and independent of input from the plurality of users.

16. The gaming device service of claim 13 wherein the session attributes include a skill rating, a connectivity speed and game specific preferences for users of the session.

17. The gaming device service of claim 13 wherein one of the games in one of the plurality of sessions includes at least two of a map parameter category, a game type parameter category, a number of players parameter category, a game speed parameter category, a duration parameter category and a vehicle parameter category.

18. The gaming device service of claim 13 wherein one of the games in one of the plurality of sessions includes at least two of a track parameter category, a car class parameter category, a number of laps parameter category, a number of cars parameter category and a weather parameter category.

* * * * *